US005813063A

United States Patent [19]

Watkins et al.

[11] Patent Number: 5,813,063

[45] Date of Patent: Sep. 29, 1998

[54] PORTABLE SINK

[76] Inventors: Louis Scott Watkins, P.O. Box 1678, Grass Valley, Calif. 95945; Shawn Mathews, 519 Nimrod, Nevada City, Calif. 95959

[21] Appl. No.: 846,462

[22] Filed: May 1, 1997

Related U.S. Application Data

[63] Continuation-in-part of Ser. No. 506,686, Jul. 25, 1995, abandoned.

[51] Int. Cl.[6] ..... A47K 1/02

[52] U.S. Cl. ..... 4/626; 4/628; 4/630

[58] Field of Search ..... 4/625, 626, 628, 4/630, 650, 653

[56] References Cited

U.S. PATENT DOCUMENTS

| | | | |
|---|---|---|---|
| 1,358,937 | 11/1920 | Curliss | 4/626 |
| 2,594,938 | 4/1952 | Leavitt | 4/626 |
| 2,944,862 | 7/1960 | Heil | 4/625 X |
| 3,594,830 | 7/1971 | Clifton | 4/625 |
| 3,983,583 | 10/1976 | Herman et al. | 4/626 X |
| 4,072,157 | 2/1978 | Wines, Jr. et al. | 4/625 X |
| 4,766,621 | 8/1988 | Rasor | 4/643 |
| 5,301,376 | 4/1994 | Herbert | 4/626 |
| 5,313,676 | 5/1994 | Wright | 4/645 |

*Primary Examiner*—Robert M. Fetsuga
*Attorney, Agent, or Firm*—Zackery Legal Group

[57] ABSTRACT

A portable sink (10) includes a housing (12) having a basin (14) movably mounted to the housing. The basin is movable from an inserted position in the housing, to a position extending from the housing. The basin includes an outlet (22) for draining fluids from the basin. When the basin is in the extended position, the outlet form the basin aligns with an inlet (26) to drain a tank (24) in the housing. Thus, in the extended position, fluid in the basin is directed through the outlet into the inlet of the drain tank. When the basin is in the inserted position, the outlet form the basin is remote from the inlet to the drain tank. The portable sink further includes a flexible spigot (78) mounted to the housing.

19 Claims, 5 Drawing Sheets

PORTABLE SINK

CROSS-REFERENCE TO RELATED APPLICATION

This application is a continuation-in-part application of prior application, Ser. No. 08/506,686, filed Jul. 25, 1995, abandoned.

FIELD OF THE INVENTION

The present invention relates generally to sinks, and in particular, to portable sinks.

BACKGROUND OF THE INVENTION

Participants in camping, picnicking, tail-gate parties, and other activities often desire access to a sink with running water during these activities. For a sink to be available to the participants, the sink would have to be portable, and have access to a water supply and a drain tank.

There have been past attempts at providing a portable sink. For example, U.S. Pat. Nos. 3,594,830, 3,983,583 and 4,072,157 all disclose devices rolled about on wheels, which include a basin, apparatus for supplying water to the basin, and usually a drain tank. However, the devices disclosed in these patents are all too heavy and bulky to be practical for true portable, outdoor use at locations that are remote from one another.

U.S. Pat. Nos. 2,944,862, 4,766,621, and 5,313,676 each disclose devices which are supported by telescoping and/or folding legs. These devices are generally more compact, and of lighter weight design, but are still too bulky, include projections, sharp edges and corners that prevent these designs from being practical for portable use.

U.S. Pat. Nos. 1,358,937, 2,594,938, and 5,301,376 all disclose portable sinks. However these sinks all lack counter space, and/or other essential features. The present invention provides an improved portable sink.

SUMMARY OF THE INVENTION

The present invention provides a portable sink for camping, "tail-gate" parties, picnics, and other activities. The portable sink includes a housing having a basin movably mounted to the housing. The basin is movable from an inserted position in the housing, to a position extending from the housing.

The basin includes an outlet for draining fluids from the basin. When the basin is in the extended position, the outlet from the basin aligns with an inlet to a drain tank in the housing. Thus, in the extended position, fluid in the basin is directed through the outlet into the inlet of the drain tank. When the basin is in the inserted position, the outlet from the basin is remote from the inlet to the drain tank.

The portable sink further includes a flexible spigot mounted to the housing. When the basin is in the extended position, the outlet of the spigot extends over the basin for ejecting fluid into the basin. Additionally, the flexible spigot permits aiming the direction of fluid ejection in a plurality of directions. After aiming the direction of fluid ejection in a selected direction with the flexible spigot, fluid ejection remains substantially aimed in the selected direction without requiring a person to manually hold the flexible spigot, thus permitting advantageous hands-free washing. Preferably, an electric pump connects the spigot in fluid communication with a supply of a fluid. A switch mounts to the basin for electrically connecting the pump to a supply of electrical power when the switch is closed, and for cutting the electrical power supply to the pump when the switch is opened.

The sink additionally includes a foot pedal electrically connecting the pump to supply of electrical power when the foot pedal is depressed, and disconnecting the pump from the electrical power supply when the foot pedal is raised. Conservation of the supply of liquid and of electrical power for the sink can be maximized by selectively actuating the foot pedal.

The sink includes a number of features that permit the sink to "fold" to a compact configuration for maximum portability. For example, wing portions hingedly mount to the housing for providing additional counter and storage space. The wing portions rotate about a hinge axis from a folded position with the bottom of the wing portion against the housing, to an extended position with the wing portion projecting away from the housing. A flexible material extends from the housing to the bottom of the wing portions to form an enclosure underneath the wing portions for storage when the wing portion is in the extended position.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
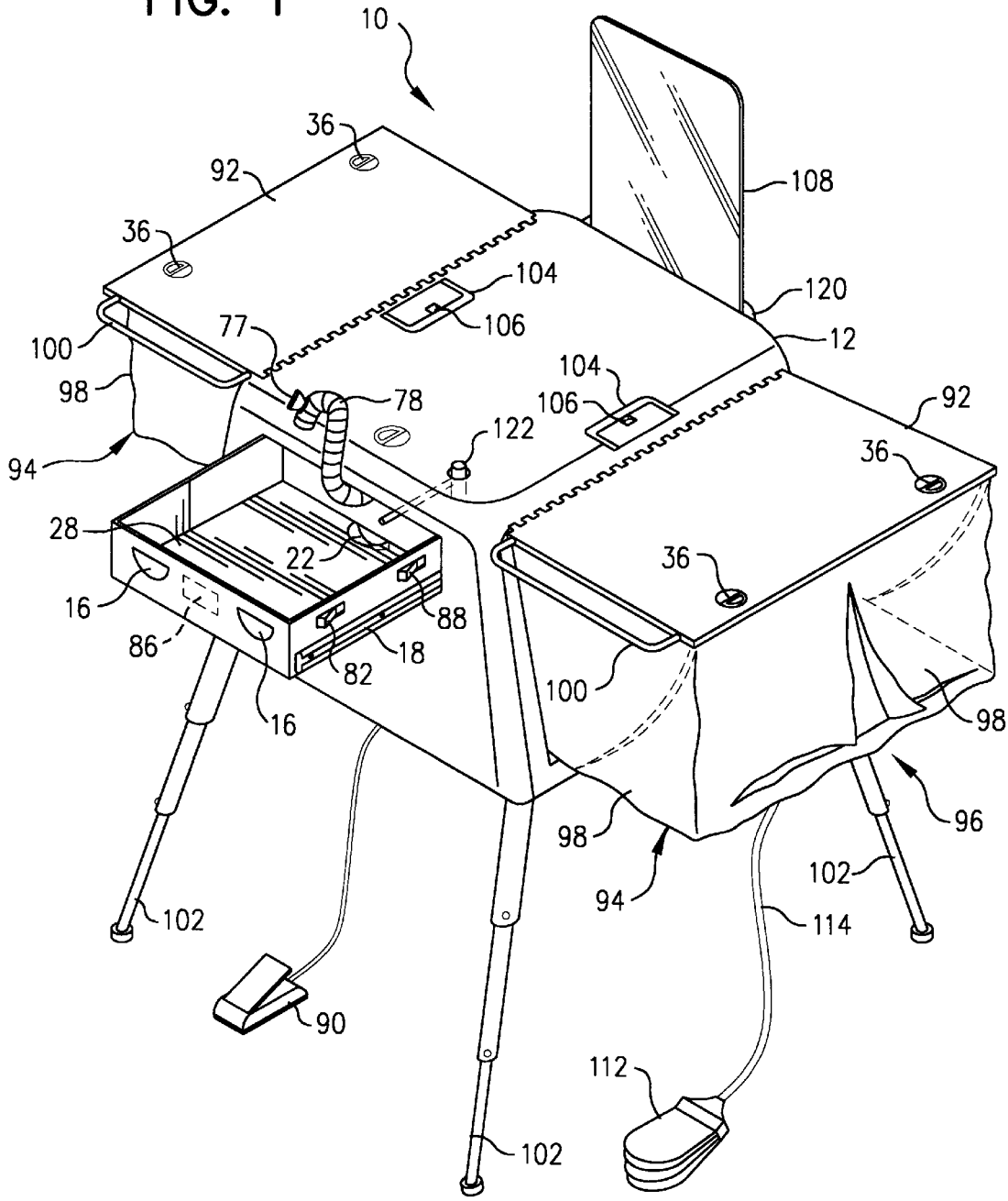
FIG. 1 is a perspective view of a preferred embodiment of a portable, self-contained sink in accordance with the present invention.

Referring to FIG. 1, a portable sink 10 constructed in accordance with the present invention includes a housing 12 having a basin 14 movably mounted therein, and a drainage system, a fresh water system, and an electrical system for servicing the basin. The housing 12 has the shape of a hollow pyramid having steep side walls, and a horizontally truncated peak. The flat surface defined by the truncated peak forms the top of the housing 12 and serves as counter space. For maximum portability, and ruggedness, the housing 12 is made of a durable plastic material. The top surface of the housing is preferably made of a conventional plastic material used to form cutting boards, such as a high molecular weight nylon polymer.

The basin 14 is in the form of a drawer inserted into the front of the housing 12. The basin 14 slides generally horizontally from a recessed position in the housing 12, to an extended position projecting from the housing. Recesses 16 formed in the front of the basin 14 provide convenient hand-grips for moving the basin between the inserted and extended positions. Preferably, the basin 14 automatically locks in both the inserted and extended positions. A user unlocks the basin 14 by taking some action, such as applying a slight lifting force to the basin. The locking system could be a friction fit, a latch mechanism, or other type of automatic locking method. In the preferred embodiment, the basin 14 moves on tracks 18 mounted to the sides of the basin 14, which ride on rails 20 (see FIG. 3) in the interior of the housing 12.

Figure 3:
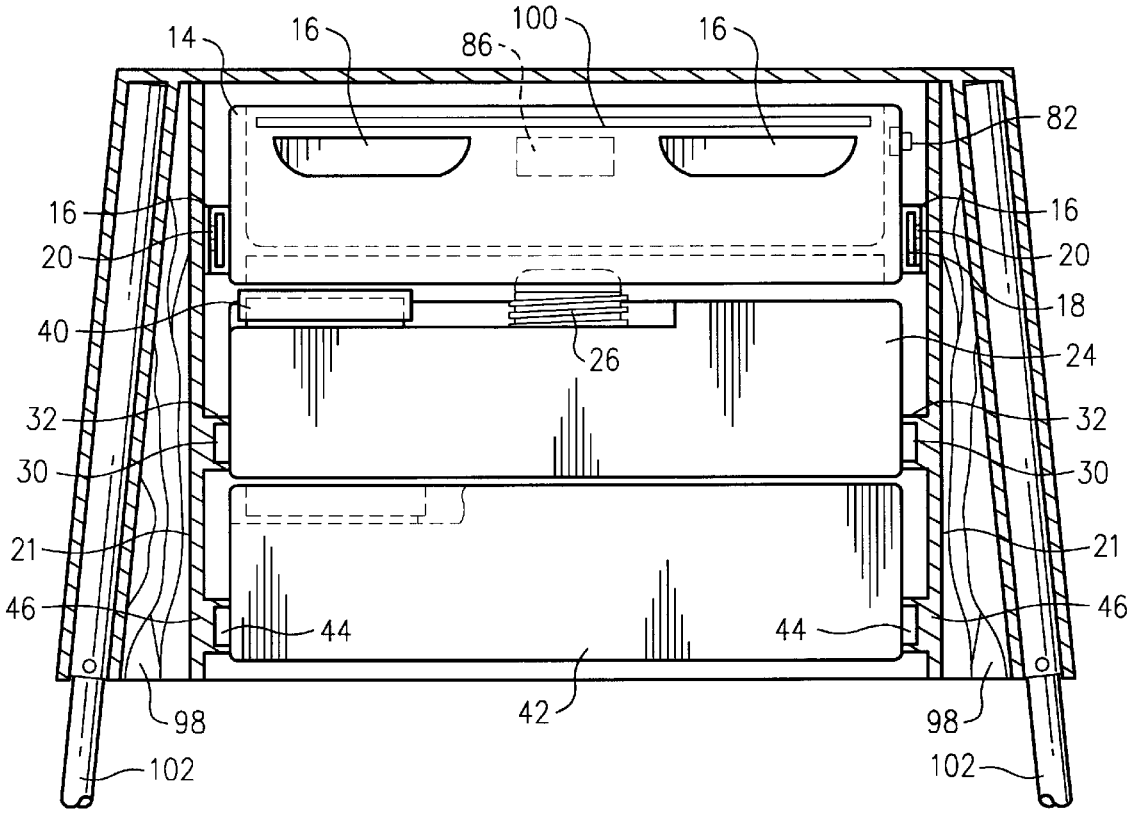
FIG. 3 is a front elevational view of the sink of FIG. 1 with part of the sink cut away to show internal components.

Referring to FIG. 3, the housing 12 includes two internal, spaced, generally vertical walls 21. The rails 20 transversely extend inwardly from the walls 21, and are received by the tracks 18 on the basin 14. The rails 20 may include rollers (not shown) which roll in the tracks 18 to reduce friction. Preferably, the basin 14 includes a latch (not shown) for locking the basin 14 in both the extended and inserted positions in the housing 12.

Figure 5:
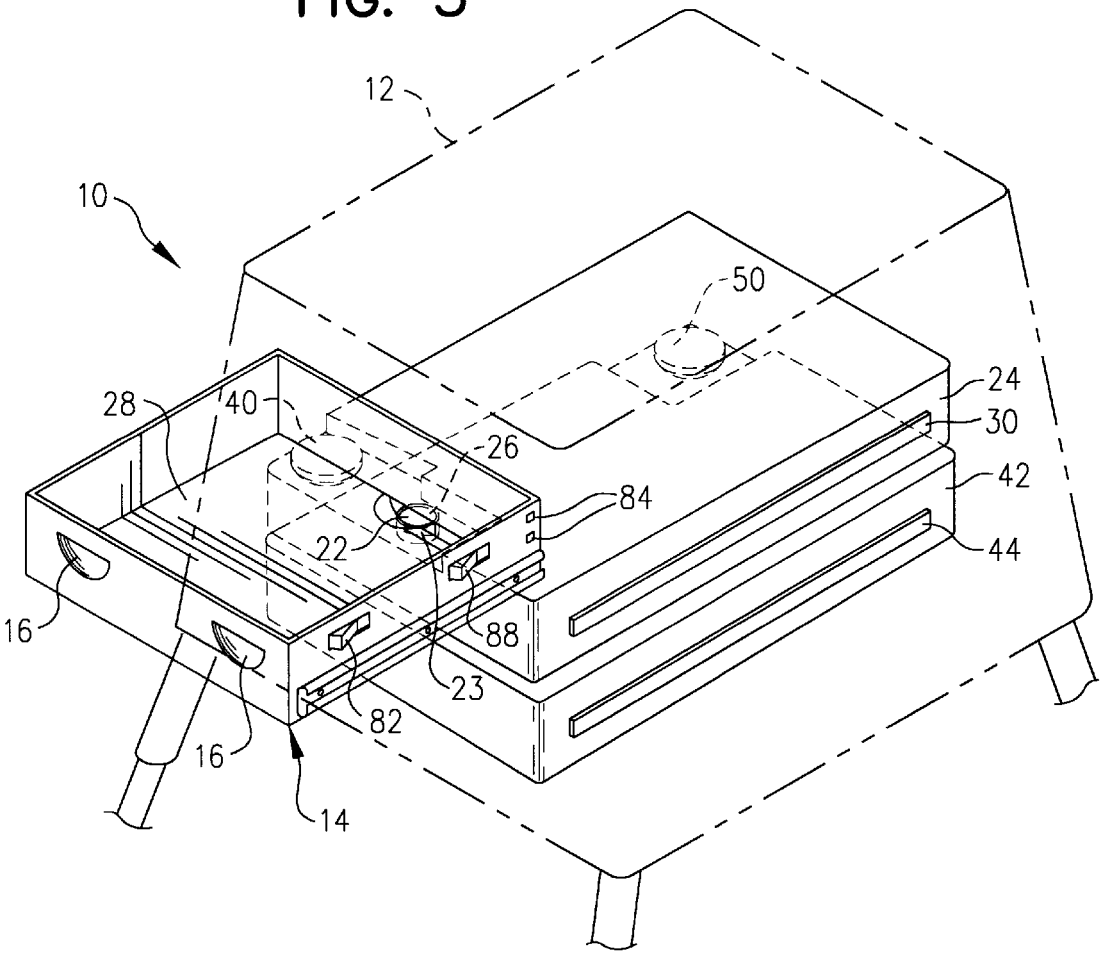
FIG. 5 is a perspective view of part of the sink of FIG. 1 with portions shown in phantom.

Referring back to FIGS. 1 and 2, the drainage system includes an outlet 22 positioned at the bottom, rear of the basin 14, and a drainage tank 24 located below the basin in the housing 12. The outlet 22 may be stopped with an external plug (not shown) or a built-in plug (not shown) for retaining fluids in the basin. When the basin 14 fully extends, the outlet 22 from the basin substantially aligns with an inlet 26 to the drainage tank 24 as shown in FIG. 5, for draining fluids from the basin when the plug is removed from the outlet.

More particularly, the outlet 22 generally forms a semicircle shape at the bottom rear of the basin 14, with the flat-edge of the semicircle shape facing the rear wall of the basin. A channel 23 extends downwardly from the outlet 22 underneath the basin 14 for a short distance. The distal end of the channel 23 aligns with the inlet 26 to the drainage tank 24 when the basin 14 is in the extended position. Thus, in the extended position, fluids in the basin 14 drain through the outlet 22 and are directed or funneled through the channel 23 into the inlet to the drainage tank 24.

Preferably, the bottom 28 of the basin 14 slopes from the front of the basin to the rear to facilitate drainage through the outlet 22. The drainage tank 24 generally has the shape of a right-rectangular parallelepiped, and is made of conventional plastic material. The drainage tank 24 slidably inserts into the housing 12 generally parallel to the direction of movement followed by the basin 14. Integral rails 30 parallel to the direction of movement of the basin 14 extend from the longitudinal edges of the drainage tank 24. Tracks 32 in the interior of the housing 12 slidably receive the rails 30 as shown in FIG. 3. Preferably, the tracks 32 are integral with the internal vertical walls 21 in the housing 12.

Figure 4:
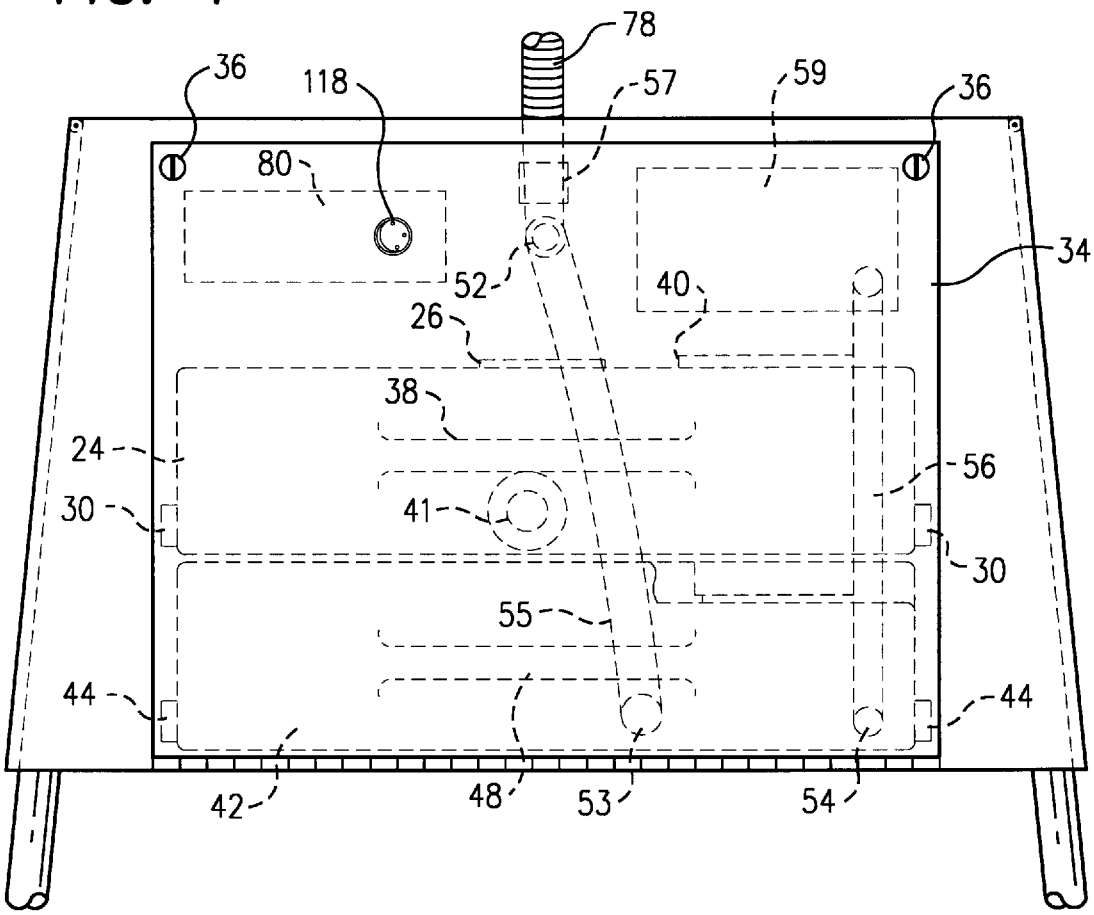
FIG. 4 is a rear elevational view of the sink of FIG. 1.

The drainage tank 24 inserts into the housing 12 from the rear. More particularly, a door 34 closes the rear of the housing as shown in FIG. 4. The door 34 generally forms the shape of a rectangle, and extends between the two internal vertical walls 21 (see FIG. 3) in the housing 12. The lower edge of the door 34 is hingedly mounted to the lower edge of the housing 12. A pair of conventional recessed type fasteners 36 removably fasten the top corners of the door 34 to the top edge of the housing 12. To remove or insert the drainage tank 24, one unfastens the door 34, swings it downward, and then slides the tank in or out of the housing. The drainage tank 24 preferably includes an integral handle 38 on its rear edge for convenient insertion and removal of the tank from the housing 12.

The drainage tank inlet 26 is located centrally on top of the tank 24 proximate the front edge of the tank. The drainage tank 24 also includes a drainage outlet 40. Preferably, the drainage outlet 40 includes a removable cap, and is located on top of the tank 24 proximate a corner of the tank for convenient draining of the tank when the tank is removed from the housing 12.

The drainage tank 24 additionally includes a side outlet 41 located in the rear side edge of the tank below the handle 38. The side outlet 41 includes a lid having a gasket threadably securable to the side outlet for sealing the outlet. The side outlet 41 is for connection to an external drainage system if available, using a hose.

The fresh water system includes a tank 42 located below the drainage tank 24 for holding clean or fresh water. The fresh water holding tank 42 is formed of plastic, and is similar in construction to the drainage tank 24. Specifically, the holding tank 42 generally has the shape of a right-rectangular parallelepiped, and includes integral rails 44 extending transversely from its longitudinal edges. Tracks 46 extend from the vertical internal walls 21 in the housing 12, which slidably receive the rails 44 as shown in FIG. 3. Preferably, the tracks 46 are formed integrally with the walls 21.

The fresh water holding tank 42 inserts into the housing 12 from the rear, generally parallel to the direction in which the basin 14 moves. To insert and remove the holding tank 42 from the housing 12, persons unfasten the door 34 at the rear of the housing 12, swing it downward, and insert or remove the tank. The fresh water holding tank 42 includes an integral handle 48 on its rear edge for convenient insertion and removal of the tank from the housing 12.

The fresh water holding tank 42 includes an inlet 50 for filling the tank with water. The inlet 50 is preferably formed on top of the tank 42 proximate one of the rear corners. A lid having a gasket threadably secures to the first inlet 50 for removably sealing the inlet. The inlet 50 is also for pressurizing the fresh water holding tank 42 with a manual pump as will be described later.

The fresh water holding tank 42 has two outlets 53 and 54 formed proximate the lower, rear edge of the tank. The first outlet 53 is located nearer the center of the tank 42 than the other outlet 54. One end of a flexible hose 55 removably connects to the first outlet 53. The other end of the hose 55 extends upwardly above the drainage tank 24, and removably connects to the inlet of a pressure regulator 52 positioned centrally below the rear, top edge of the housing 12. The method of removable connection may be by any method known in the art, but preferably the hose 55 includes a conventional female garden-type fitting that removably threads to conventional male garden hose type fittings extending from the outlet 54 and the pressure regulator 52.

Preferably, the pressure regulator 52 is of conventional design and can accept a supply of water having a pressure of up to 100 psi, while providing water at the regulator's outlet in the range from 15–20 psi. A regulator suitable for practicing the present invention is available from Raindrip Inc. of Chadsworth, Calif.

Figure 2:
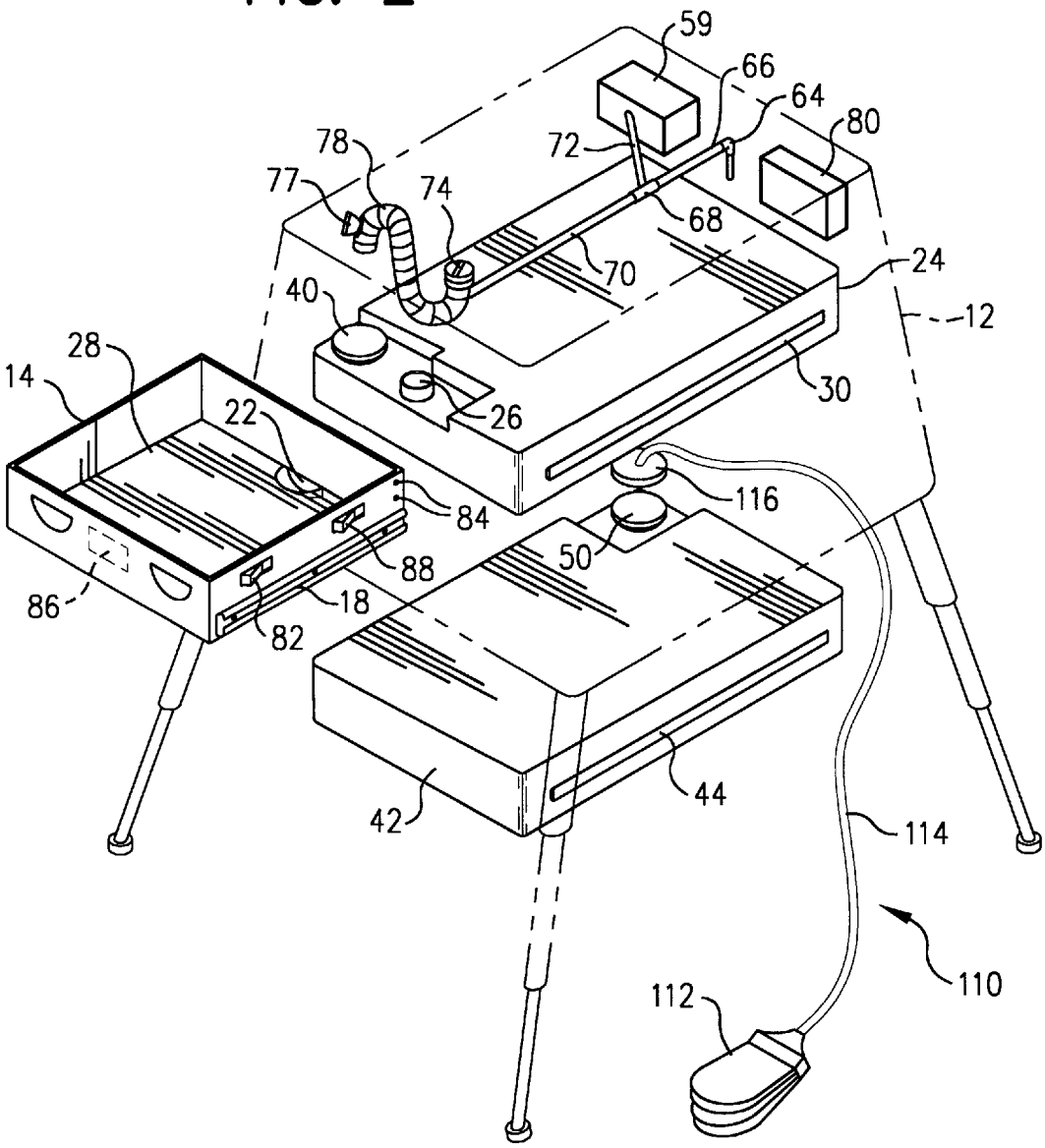
FIG. 2 is a partially exploded, perspective view of part of the sink of FIG. 1 with portions shown in phantom outline.

The outlet from the pressure regulator 52 connects to the inlet of a conventional check valve 57. The check valve 57 substantially only permits water to flow through the check valve in the direction from the regulator 52, and not in the reverse direction. Referring to FIG. 2, the outlet from the check valve 57 connects to one end of an elbow 64. The other end of the elbow 64 connects to a pipe 66 extending centrally underneath the top of the housing 12. The other end of the pipe 66 connects to a first end of a tee or Y-type fitting 68.

A second end of the Y-type fitting 68 connects the pipe 66 in fluid communication with a second pipe 70 extending centrally underneath the top surface of the housing 12 from the Y-type fitting to the front of the housing (the edge of the housing from which the basin 14 extends). The remaining end of the Y-type fitting 68 preferably connects to the outlet of a second conventional check valve 72. The check valve 72 substantially only permits water to flow through the check valve in the direction towards the Y-type fitting 68, and not in the reverse direction. The other end of the check valve 72 connects to the outlet from a pump 59 as described later.

The front or forward end of the second pipe 70 connects to one end of a conventional shut-off valve 74. The shut-off valve 74 mounts to the underside of the top surface of the housing 12, so that the handle for the shut-off valve is accessible through a recess in the top of the housing as shown in FIG. 1.

The other end of the shut-off valve 74 connects to a flexible spigot 78. The spigot 78 projects over the basin 14 when the basin fully extends from the housing 12. The distal end of the spigot 78 may include a shut-off valve 77, either separately attached or as an integral part, for shutting the flow of water off and on at the distal end of the spigot.

The spigot 78 is made of plastic and has a construction as in conventional rinse hoses used for parts washers in the automotive industry. In particular, plastic rinse hoses for parts washers may be obtained from the Kleer-Flo Company of Eaton Prairie, Minn. In this regard, the spigot 78, as with conventional rinse hoses for parts washers, may be manually bent or aimed, while substantially retaining the configuration to which it is "bent". That is the spigot 78 has a "goose-neck" construction, permitting the spigot 78 to be advantageously aimed in different directions, and the spigot will substantially remain pointing in the direction in which it is aimed, for permitting hands-free washing with the sink 10. More particularly, the spigot 78 may be aimed downward, to the side, upward, and orientations in between, and substantially remain in the aimed direction for permitting hands-free washing with the sink 10. Additionally, the spigot 78 can be folded into the basin 14 when the basin retracts into the housing 12 for convenient transport.

The elbow 64, the pipes 66 and 70, the Y-type fitting 68, and the valves 57, 72, and 74 are all preferably formed of conventional plastic for light weight. Some or all of these components may be formed integrally with one another. In alternate embodiments, the elbow 64 and pipes 66 and 70 may be replaced with hoses.

A second flexible hose 56 removably connects to the second outlet 54 in the fresh water holding tank 42. The hose 56 extends upwardly to a location above the drainage tank 24, and behind the basin 14, where the other end of the hose removably connects to the inlet of a pump 59. The removable connections for the second hose 56 may be of the same type as for the first hose 55.

The pump 59 is preferably a self-priming, conventional electrical pump. Suitable pumps for practicing the present invention include low voltage, self-priming pumps manufactured by Shurflow of Santa Ana, Calif. As previously noted, the outlet from the pump 59 connects to one end of the Y-type fitting 68 underneath the top surface of the housing 12.

The fresh water system operates in three modes, manual pumping system mode, municipal water supply mode, and electrical pumping mode. For manual pumping mode, the sink 10 includes a manually operated pump system I 10 as shown in FIG. 2. The manually operated pump system 110 preferably includes a conventional foot-operated bellows type of pump 112 for supplying pressurized air. The outlet from the manually-operated pump 112 connects to one end of a flexible hose 114. The other end of the hose 114 connects to a fitting 116 adapted to threadably engage the inlet 50 to the fresh water holding tank 42.

To use the manually operated pumping system 110, the fresh-water holding tank 42 is prefilled with water, and the lid of the inlet 50 to the fresh water holding tank 42 is replaced with the fitting 116. The fitting 116 includes an internal gasket (not shown), which forms a substantially air-tight seal between the fitting and the inlet 50. Thereafter, the manual pump 112 is operated, which pressurizes the fresh water holding tank 42 with air. The air forces water from the tank 42 through the first outlet 53, and up the hose 55 to the pressure regulator 52.

From the pressure regulator 52 the water flows through the first check valve 57, the elbow 64, the first pipe 66, the Y-type fitting 68, and the second pipe 70, the shut-off valve 74, and then through the spigot 78. In the manual pumping system mode, water flow through the spigot 78 is controlled by turning either of the shut-off valves 74 or 77 off and on that are connected to the spigot. The check valve 72 connected to the Y-type fitting 68 ensures no water flows into the outlet to the pump 59.

In the municipal water supply mode, the pressure regulator 52 connects to a hose from an external pressurized water source, such as a municipal water supply. For this purpose, a tee or Y-type fitting (not shown) may be connected to the pressure regulator 52, along with a check valve (not shown) and a third hose (not shown) so that the pressure regulator may be connected to both the fresh water holding tank 42 and the external pressurized water source at the same time. Alternatively, the hose 55 may be disconnected from the fresh water holding tank 42 and connected to the pressurized water source, and the first outlet 53 from the tank capped or shut off with a valve (not shown). Another possibility is to disconnect the hose 55 from the pressure regulator 52, cap or shut this end of the hose off, and connect the pressure regulator to the pressurized water source with a third hose. In all of these situations, preferably a conventional hose type shut-off valve (not shown) is disposed between the pressurized water source and the pressure regulator 52 for shutting the external supply of pressurized water off.

The pressurized water thereafter flows through the pressure regulator 52, and follows the same path to the spigot 78 as described earlier in connection with the manual pumping system mode. In the municipal water supply mode, water flow through the spigot 78 is controlled by turning either of the shut-off valves 74 or 77 off and on that are connected to the spigot. Hence, in both the manual pumping system mode, and the municipal water supply mode, the pump 59 in the sink 10 does not operate.

In the electrical pumping mode, the fresh water holding tank 42 is pre-filled with water. When the pump 59 is operated, the pump draws water from the outlet 54 of the holding tank 42 and upwardly through the hose 56. The water then flows into the pump 59 and through the pump's outlet into the check valve 72. From the check valve 72 the water flows into the Y-type fitting 68, through the pipe 70, through the shut-off valve 74, and finally through the spigot 78. In the electrical pumping mode, the shut-off valves 74 and 77 connected to the spigot 78 are preferably left continuously open, and water flow through the spigot is controlled by operating the pump 59.

The electrical system includes a conventional rechargeable battery 80 located in an upper rear corner of the housing 12, opposite the pump 59 as shown in FIGS. 2 and 4. The battery 80 provides the electrical power for operating the pump 59. In the preferred embodiment, the battery 80 is a nickel-cadmium rechargeable type, but may be a lead-acid, or other type in alternate embodiments. A battery suitable for practicing the present invention is the model 9000 battery manufactured by Makita U.S.A. Inc., of La Mirada, Calif., which is a 9.6 volt rechargeable nickel-cadmium battery.

When the battery 80 is discharged, it may be removed from the housing through the door 34 for recharging. While the battery 80 recharges, a substitute charged battery may be used. Alternatively, the battery 80 may be recharged in place by connecting the battery to a supply of electrical power through an external power connection 118 at the rear of the housing as shown in FIG. 4. Preferably, the external power connection can accept electrical power from any 12 volt direct current power source, such as from a power cord connected to the plug for a cigarette lighter in a motor vehicle, or alligator clips connected to some other external source of electrical power, such as a solar panel, another battery, or other source of electrical power. The external power connection 118 may include a voltage converter for adjusting the input voltage, and can be used operate the sink 10, and recharge the battery 80 at the same time.

Electrical power to the pump 59 from the battery 80 is controlled through a conventional switch 82 preferably located on the exterior of one side of the basin 14 as shown in FIGS. I and 2. A pair of electrical contacts 84 are provided on the rear of the basin 14 (see FIG. 2), and corresponding electrical contacts (not shown) are located in the housing 12. When the basin 14 fully extends, the electrical contacts 84 on the basin 14 and in the housing 12 contact one another. Conventional wiring in the housing 12 routes electrical power from the battery 80 to the electrical contacts in the housing 12, while conventional wiring routes electrical power from the electrical contacts 84 on the basin 14 to the switch 82.

The electrical system also includes a light 86 located in the front of the basin 14 for illuminating the interior of the basin 14. A switch 88 located on the side of the basin 14 controls electrical power to the light 86 from the battery 80. Conventional wiring from the electrical contacts 84 route electrical power to the light 86 and light switch 88 when the basin 14 is fully extended.

Preferably, both of the switches 82 and 88 on the side of the basin 14 are automatically placed in the open or "off" condition when the basin 14 is inserted into the housing 12 to cut electrical power to the pump 59 and the light 86. The mechanism for doing this could be a spring biased bar or rod (not shown) in the housing 12. When the basin 14 slides inwardly into the housing 12, the bar is held rigidly in place. As the switches 82 and 88 slide past the bar on the basin 14, the bar presses against the switches to place the switches in the open or off state. However, when the basin 14 slides outwardly or extends, a spring mechanism permits the bar to retract so that the switches remain in the open or off state.

Referring to FIG. 1, the electrical system further includes a foot-pedal switch 90 in the form of a simple, conventional on/off switch for controlling the flow of electrical power to the pump 59. The foot pedal switch 90 is biased to remain in the off or open state. When a pressing force is applied to the foot-pedal switch 90, electrical power flows to the pump 59 from the battery 80. When the pressing force is removed, the foot-pedal switch 90 opens, and electrical power is no longer supplied to the pump 59 from the battery 80.

The sink 10 includes a number of features that enable the sink to "fold-up" to a compact configuration for maximum portability. More particularly, a wing portion 92 hingedly connects to each top, side edge of the housing 12. The wing portions 92 generally form the shape of a rectangle, with one of the longer sides connected to the housing 12. The wing portions 92 rotate about their hinge axis from a folded position adjacent the side walls of the housing 12, to a position projecting transversely away from the housing for providing additional counter space and storage. The wing portions 92 include conventional recessed type fasteners 36 for removably fastening the wing portions 92 to the sides of the housing 12 when the wing portions fold thereagainst. Preferably, the wing portions 92 are formed of plastic. The fasteners 36 are the same type as those used for removably fastening the rear door 34 of the housing 12.

A fabric connects between the bottom edges of the wing portions 92 and the sides of the housing 12. When the wing portions 92 fold to the position extending away from the housing 12, the fabric forms a generally right parallelepiped enclosure 94 underneath each wing portion for storage. The enclosures 94 each include an opening 96 facing away from the housing 12. The openings 96 seal using any type of conventional fastening material such as VELCRO (D, zippers, snaps, ties, hooks and loops, etc. Preferably, the fabric is formed of a rugged, breathable, nylon material commonly used to construct camping gear, such as backpacks, tents, and etc. When the wing portions 92 fold against the sides of the housing 12, the fabric folds into a space against the internal vertical walls 21 in the housing as shown in FIG. 3.

Preferably, the fabric forming the enclosures 94 connects underneath the wing portions 92 at distance spaced away from the edges of the wing portions in the range of ¼ to ¾ of an inch. The spacing creates a lip overhanging the enclosures 94 so that the wing portions 92 can fold against the housing 12 without fabric being caught between the edges of the wing portions and the housing.

Returning to FIG. 1, when the wing portions 92 fold-out and extend away from the housing, flaps 98 can be unfolded in the interior of the enclosures 94 to support the wing portions in the extended position. More particularly, a pair of flaps 98 hingedly connect to each side of the housing 12 in the interior of the enclosures 94. The flaps 98 connect proximate the sides of the enclosures, and rotate about an axis generally transverse to the axis the wing portions 92 rotate about. Persons unfold the flaps 98 by reaching through the openings 96 in the enclosures 94. When the flaps 98 are unfolded, the wing portions 92 bear against the tops of the flaps 98 to retain the wing portions 92 in an extended position. The flaps 98 also stiffen the side walls of the enclosures 94. Preferably the flaps 98 are formed of plastic.

Hinged hooks (not shown) may be connected to the bottoms of the wing portions 92 in the interior of the enclosures. When the wing portions 92 fold against the housing 12, the hooks fold against the wing portion so that the wing portions may lay flat against the housing. When the wing portions 92 extend, the hooks fold downward so that the cups, and other items can hang therefrom.

Towel racks 100 project from the frontward-facing edges of the wing portions 92. The towel racks 100 slide from an inserted position underneath the surface of the wing portions 92, to an extended position projecting away from the wing portions.

Preferably, four telescoping legs 102 extend from proximate the four lower corners of the housing 12 and support the housing above a surface. In the preferred embodiment, the legs 102 are fully retractable into the housing.

Two handles 104 centrally connect to opposite top, side edges of the housing 12. The handles 104 hingedly connect to the housing 12, and rotate about their hinge axis to project orthogonally from the top of the housing 12 for providing convenient hand-grips. When not in use the handles 104 rotate out of the way towards the center of the housing 12 into recesses formed therein. Finger depressions 106 formed adjacent the recesses facilitate rotating the handles 104 back to the orthogonal position.

A retractable mirror 108 connects centrally to the top edge of the door 34 to the housing 12 as shown in FIG. 1. More particularly, the mirror 108 retracts and extends from a pocket 120 mounted to the exterior of the door 34. (The pocket 120 is not shown in the other figures for clarity). Preferably, the mirror 109 is lockable in both the retracted and extended positions. The locking system could be a friction fit, a latch mechanism, or other type of locking method.

The sink 10 may also include a manual, pump-type liquid soap dispenser 122 located at the front of the housing 12 to one side of the spigot. The dispenser 122 connects to a reservoir (not shown) in the housing 12, from which liquid soap may be pumped.

While the preferred embodiment of the invention has been illustrated and described, it will be appreciated that various changes can be made therein without departing from the spirit and scope of the invention. By way of illustrative non-limiting example, the legs 102 could fold against the housing 12, rather than telescope; the battery 59 could be a long-life non-rechargeable type, rather than a rechargeable battery; the channel 23 from the basin outlet 22 could be a tube; the sink 10 could be formed so that the outlet 22 closely aligns over the inlet 26 to the drainage tank 24 such that the channel 23 could be eliminated; and the electrical contacts 84 could be eliminated and replaced with a flexible wire harness for movably providing electrical power to the basin 14; the basin 14 could pivot out of the housing 12, rather than slide out.

Regarding a pivoting basin, such a basin would preferably pivot about a substantially vertical axis, located at one corner of the basin. In this alternative embodiment, the basin would therefore swing substantially horizontally, in and out, of the housing 12. Such a basin would thus swing in an arc of approximately ninety degrees, as the basin extends and retracts from the housing 12. When the basin swings out to a fully extended position from the housing, the outlet from the basin would substantially align with the inlet to a drainage tank, as in the previously described preferred embodiment.

Electrical power could be supplied to such a basin through conventional wiring routed along one of the basin's side; preferably a side of the basin extending from the corner from which the basin pivots. Hence, minimal extension of the wiring would be required as the basin opens to the fully extended position. Likewise, minimal folding/flexing of the wiring would be required when the basin closes to the fully retracted position.

Preferably switches for the pump and basin light would mount to the top edge of one of the basin's sides. When the basin retracts into the housing, the switches would automatically be placed in the off position or state. The mechanism for doing this could be one or more spring biased bars or rods in the housing. When the basin retracts into the housing, each switch slides under such a bar, and the bar is held rigidly in place. As a switch slides under such a bar, the bar presses against the switch, placing the switch in the off position. However, when the basin extends, a spring mechanism permits the bar to retract so that the bar does not affect the state or position of the switch.

Alternatively, the basin could rotate about a substantially horizontal axis, located along the rear side of the basin. Such a basin would preferably fold downward, to a substantially horizontal orientation when fully extended from the housing. When retracting, the basin would preferably fold upward, to a substantially vertical orientation in the front of the housing. When the basin fully extends from the housing, an outlet from the basin would substantially align with the inlet to a drainage tank, as in the previously described preferred embodiment.

Electrical power could be supplied to such a basin through wiring routed from the housing along the rear side of the basin, as done in supplying electrical power from the keyboard to the display of many conventional lap-top computers. Switches for the pump and basin light would preferably mount to the front side of the basin. A spring biased bar or rod arrangement in the housing, as previously discussed, would automatically place the switches in the off state when the basin retracts into the housing.

In view of these and other alterations, substitutions and modifications that could be made by one of ordinary skill in the art, it is intended that the scope of letters patent granted hereon be limited only by the definitions of the appended claims.

The embodiments of the invention in which an exclusive property or privilege is claimed are defined as follows:

1. A portable sink, comprising:

(a) a housing;

(b) a basin movably mounted to the housing, the basin movable from a recessed position in the housing, to an extended position from the housing, the basin including an outlet for draining fluids from the basin; and (c) a drain tank disposed in the housing and having an inlet, the outlet from the basin being remote from the inlet to the drain tank when the basin is in the inserted position and the drain tank is in the housing, and the outlet from the basin aligning with the inlet to the drain tank when the basin is in the extended position and the drain tank is in the housing, where fluid in the basin is directed through the outlet into the inlet of the drain tank.

2. The portable sink of claim 1, further comprising a flexible spigot mounted to the housing for delivering fluid into the basin.

3. The portable sink of claim 1, further comprising a spigot mounted to the housing, the spigot having an outlet extending over the basin when the basin is in the extended position.

4. The portable sink of claim 3, further comprising:

(a) an electric pump connecting the spigot in fluid communication with a supply of a liquid; and (b) a switch mounted to the basin having an open position and a closed position, the switch electrically connecting the pump to a supply of electrical power when switch is in the closed position, and the switch disconnecting the pump from the supply of electrical power when the switch is in the open position.

5. The portable skin of claim 3, further comprising:

(a) an electric pump connecting the spigot in fluid communication with a supply of liquid; and (b) a foot pedal electrically connecting the pump to a supply of electrical power when the foot pedal is subjected to a pressing force, the foot pedal disconnecting the pump from the supply of electrical power when the foot pedal is no longer subjected to the pressing force.

6. The portable sink of claim 1, further comprising:

(a) an electric light mounted to the basin; and (b) a supply of electrical power connected to the light.

7. A portable sink, comprising:

(a) a housing;

(b) a basin movably mounted to the housing, the basin movable from an recessed position in the housing, to an extended position from the housing, the basin including an outlet for draining fluids from the basin;

(c) a drain tank having an inlet, the outlet from the basin being remote from the inlet to the drain tank when the basin is in the inserted position, and the outlet from the basin aligning with the inlet to the drain tank when the basin is in the extended position where fluid in the basin is directed through the outlet into the inlet of the drain tank;

(d) a wing portion having a bottom and an edge, wherein the edge hingedly mounts to the housing so that the wing portion is rotatable about a first hinge axis from a folded position with the bottom of the wing portion against the housing, to an extended position with the wing portion projecting away from the housing; and (e) a flexible material extending from the housing to the bottom of the wing portion to form an enclosure underneath the wing portion for storage when the wing portion is in the extended position.

8. The portable sink of claim 7, further comprising a towel rack mounted to the wing portion, the towel rack being movable from an inserted position in the wing portion, to an extended position projecting from the wing portion.

9. The portable sink of claim 7, further comprising a flap having a rear side and an edge, wherein the edge hingedly mounts to the housing below the wing portion, the flap being rotatable from a folded position with the rear side against the housing, to an extended position with the flap projecting from the housing.

10. The portable sink of claim 7, wherein a second wing portion hingedly connects to the other side of the housing, opposite from the first wing portion.

11. A portable sink, comprising:

(a) a housing;

(b) a basin movably mounted to the housing, the basin movable from an inserted position in the housing, to an extended position from the housing, the basin including an outlet for draining fluids from the basin; and (c) flexible spigot means mounted to the housing for ejecting fluid into the basin, and for aiming the ejection of fluid in a plurality of directions, wherein after aiming the ejection of fluid in a selected direction with the flexible spigot means, the ejection of fluid remains substantially aimed in the selected direction without requiring a person to manually hold the flexible spigot means.

12. The portable sink of claim 11, where the flexible spigot means includes an outlet extending over the basin when the basin is in the extended position.

13. The portable sink of claim 12, further comprising a drain tank having an inlet, the outlet from the basin being remote from the inlet to the drain tank when the basin is in the inserted position, and the outlet from the basin aligning with the inlet to the drain tank when the basin is in the extended position, with the outlet from the basin remaining in the housing when the basin is in the extended position, wherein fluid in the basin is directed through the outlet into the inlet of the drain tank.

14. The portable sink of claim 11, further comprising:

(a) an electric pump connecting the flexible spigot means in fluid communication with a supply of a liquid; and (b) a switch mounted to the basin, which electrically connects the pump to a supply of electricity when the switch is subjected to a pressing force, the switch disconnecting the pump from the supply of electricity when the switch is no longer subjected to the pressing force.

15. The portable sink of claim 11, further comprising:

(a) an electric pump connecting the flexible spigot means in fluid communication with a supply of a liquid; and (b) a foot pedal electrically connecting the pump to a supply of electricity when the foot pedal is subjected to a pressing force, the foot pedal disconnecting the pump from the supply of electricity when the foot pedal is no longer subjected to the pressing force.

16. The portable sink of claim 11, further comprising:

(a) a wing portion having a bottom and an edge, wherein the edge hingedly mounts to the housing so that the wing portion is rotatable about a first hinge axis form a folded position with the bottom of the wing portion against the housing, to an extended position with the wing portion projecting away from the housing; and (b) a flexible material extending from the housing to the bottom of the wing portion to form an enclosure underneath the wing portion for storage when the wing portion is in the extended position.

17. The portable sink of claim 16, further comprising a towel rack mounted to the wing portion, the towel rack being movable from an inserted position in the wing portion, to an extended position projecting from the wing portion.

18. The portable sink of claim 16, further comprising a flap having a rear side and an edge, wherein the edge hingedly mounts to the housing below the wing portion, the flap being rotatable from a folded position with the rear side against the housing, to an extended position with the flap projecting away from the housing.

19. The portable sink of claim 16, wherein a second wing portion hingedly connects to the other side of the housing, opposite from the first wing portion.

* * * * *